US008311473B2

(12) United States Patent
Sasaki et al.

(10) Patent No.: US 8,311,473 B2
(45) Date of Patent: Nov. 13, 2012

(54) BOOKBINDING SYSTEM, BOOKBINDING METHOD, AND COMPUTER PROGRAM PRODUCT

(75) Inventors: Takeshi Sasaki, Tokyo (JP); Hiroki Okada, Kanagawa (JP); Junichi Iida, Kanagawa (JP); Shingo Matsushita, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 728 days.

(21) Appl. No.: 12/385,746

(22) Filed: Apr. 17, 2009

(65) Prior Publication Data

US 2009/0263212 A1 Oct. 22, 2009

(30) Foreign Application Priority Data

Apr. 18, 2008 (JP) ..... 2008-109096

(51) Int. Cl.
*G03G 15/00* (2006.01)
*B42B 9/00* (2006.01)

(52) U.S. Cl. ..... 399/408; 399/407; 412/42

(58) Field of Classification Search ..... 399/407, 399/408; 412/42

See application file for complete search history.

(56) References Cited

U.S. PATENT DOCUMENTS 6,343,785 B1 2/2002 Yamada et al.
6,494,453 B1 12/2002 Yamada et al.
6,549,734 B2 4/2003 Yamada et al.
6,783,124 B2 8/2004 Tamura et al.
7,328,892 B2 2/2008 Asami et al.
7,726,928 B2 6/2010 Kurabayashi et al.
2003/0156872 A1* 8/2003 Hirai ..... 399/407
2005/0265809 A1* 12/2005 Lemens et al. ..... 412/33
2007/0182082 A1 8/2007 Asami et al.
2008/0075560 A1* 3/2008 Kurabayashi et al. ..... 412/38

FOREIGN PATENT DOCUMENTS

JP 2001206593 * 7/2001
JP 2001-316036 11/2001
JP 2003-212425 7/2003
JP 2005-138549 6/2005

OTHER PUBLICATIONS

Japanese Office Action dated Feb. 28, 2012.

* cited by examiner

*Primary Examiner* — Judy Nguyen
*Assistant Examiner* — Blake A Tankersley
(74) *Attorney, Agent, or Firm* — Harness, Dickey & Pierce, P.L.C.

(57) ABSTRACT

A bookbinding device receives a sheet on which an image is formed from an image forming apparatus. In the bookbinding device, a punching unit performs a punching process on a sheet; an aligning unit aligns a plurality of sheets on which holes are punched; and a ring binding unit mounts, in the holes of the sheets aligned by the aligning unit, a ring-shaped binding tool to create a booklet. A prohibiting unit, if a sheet received from the image forming apparatus is a punched sheet having a hole thereon, causes the punching unit not to perform the punching process on the punched sheet.

13 Claims, 13 Drawing Sheets

BOOKBINDING SYSTEM, BOOKBINDING METHOD, AND COMPUTER PROGRAM PRODUCT

CROSS-REFERENCE TO RELATED APPLICATIONS

The present application claims priority to and incorporates by reference the entire contents of Japanese priority document 2008-109096 filed in Japan on Apr. 18, 2008.

BACKGROUND OF THE INVENTION

1. Field of the Invention

The present invention relates to a bookbinding system, a bookbinding method, a computer program product, and a punched hole detecting device.

2. Description of the Related Art

Among various functions, which are included in a post-processor of an existing image forming apparatus, the post-processor includes a function in which multiple holes are punched sheet by sheet on a binding-side end portion of a sheet, sheets are arranged by a page order, and each copy is loaded onto a sheet discharge tray. An output material thus obtained is bound by a metallic coil or a plastic ring by using an off-line device or a tool. A ring-bound material is formed with this process.

A sheet processing system is known in which a plurality of operating devices such as a punch processing device and a staple processing device are connected to the image forming apparatus in a line (in a series). The punch processing device and the staple processing device execute a punching process and a stapling process with respect to the sheet on which an image is formed by the image forming apparatus. Thus, a sheet or a sheet stack is created on which a desired sheet processing is carried out.

Functions related to a bookbinding process includes a function that binds the sheet on the end portion or in a center, a function that carries out bookbinding by pressing a sheet edge on a self-adhesive tape, and a function that binds, upon punching a plurality of holes near the binding-side of the sheet stack, the sheet stack using the metallic coil or the plastic ring to form the ring-bound material. In recent years, an inline executable ring binder device has also appeared for ring binding in which the sheet stack is bound by passing the metallic coil or the plastic ring through the holes that are punched near the binding-side of the sheet stack, thus significantly increasing productivity.

A technology disclosed in Japanese Patent Application Laid-open No. 2005-138549 is a commonly known example of the technology related to such a ring binder device. In the technology mentioned earlier, a binding processor includes a punching mechanism and a binding processing mechanism that executes a binding process using binders. When a sheet from a printing device such as a copier is transmitted, the sheet strikes a stopper plate of the punching mechanism. A sheet aligning slider clamps a left and a right side of the sheet and positions the sheet. After the holes are punched by a punch block and a die, the sheet is sent to a sheet tray of the binding processing mechanism. By arranging a single set of the sheets and sandwiched pressuring ring-type binders by using a pusher, the ring-type binders are mounted into the punching holes of the sheet and a binding processed booklet is discharged in a stack tray.

A binder device, which executes the binding process according to the technology mentioned earlier, includes a multi-hole punching device. When ring binding is to be carried out, the multi-hole punching device punches multiple holes on all the sheets subjected to the binding process after the sheets are output from the image forming apparatus. Subsequently, by aligning all the sheets, the binder device executes the binding process. The multi-hole punching device, which is included in a bookbinding system or the binder device, is formed by assuming punching on a single sheet of a general thickness. For example, punching cannot be carried out on a heavy sheet or a plastic film, thus restricting creation of a ring bound booklet. If the booklet, which is punched and subjected to the binding process, is separated, the sheets of the booklet are fed from an inserter, and the booklet is to be restructured by performing changes, the holes need to be punched again, thus resulting in displacement and widening of the holes.

SUMMARY OF THE INVENTION

It is an object of the present invention to at least partially solve the problems in the conventional technology.

According to an aspect of the present invention, there is provided a bookbinding system including an image forming apparatus that forms an image on a sheet; and a bookbinding device that receives the sheet on which an image is formed by the image forming apparatus. The bookbinding device includes a punching unit that performs a punching process of forming a punching hole on a sheet; an aligning unit that aligns a plurality of sheets having punching holes; a ring binding unit that mounts, in the punching holes of the sheets aligned by the aligning unit, a ring-shaped binding tool to create a booklet; and a prohibiting unit that, if a sheet received from the image forming apparatus is a punched sheet having a punching hole thereon, causes the punching unit not to perform the punching process on the punched sheet.

According to another aspect of the present invention, there is provided an bookbinding method that ring binds a sheet carried from an image forming apparatus by using a bookbinding device that includes a punching unit that performs a punching process of forming a punching hole on a sheet; an aligning unit that aligns a plurality of sheets having punching holes; a ring binding unit that mounts, in the punching holes of the sheets aligned by the aligning unit, a ring-shaped binding tool to create a booklet. The method includes prohibiting, if a sheet received from the image forming apparatus is a punched sheet having a punching hole thereon, the punching unit from performing the punching process on the punched sheet.

According to still another aspect of the present invention, there is provided an computer program product including a computer-readable recording medium and computer program code stored on the computer-readable recording medium which when executed on a computer causes the computer to execute a bookbinding method that ring binds a sheet carried from an image forming apparatus by using a bookbinding device that includes a punching unit that performs a punching process of forming a punching hole on a sheet; an aligning unit that aligns a plurality of sheets having punching holes; a ring binding unit that mounts, in the punching holes of the sheets aligned by the aligning unit, a ring-shaped binding tool to create a booklet. The computer program code causes the computer to execute prohibiting, if a sheet received from the image forming apparatus is a punched sheet having a punching hole thereon, the punching unit from performing the punching process on the punched sheet.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention are explained in detail below with reference to the accompanying drawings.

Figure 1:
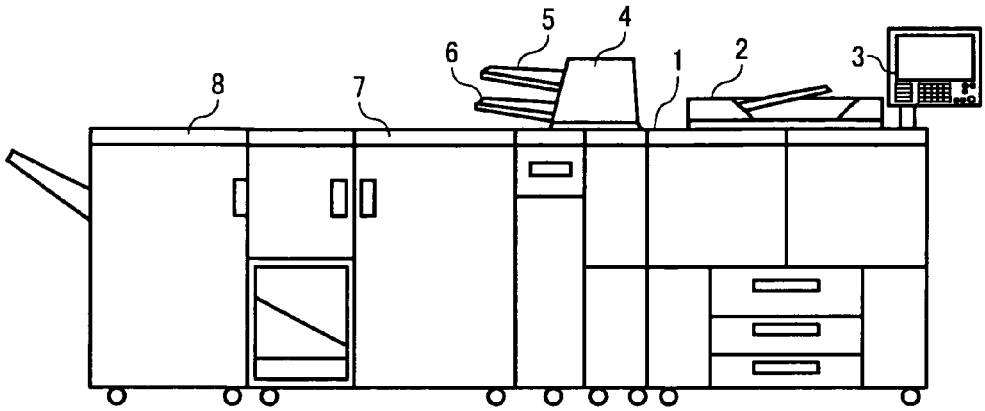
FIG. 1 is a schematic diagram of a bookbinding system according to a first embodiment of the present invention.

FIG. 1 is a schematic diagram of a bookbinding system according to a first embodiment of the present invention.

In the first embodiment, the bookbinding system includes a digital multifunction peripheral (MFP) 1 that includes at least two functions among a copy function, a printing function, and a facsimile function. The MFP 1 also includes an auto document feeder (ADF) 2 and an operation panel 3 with a display device. An inserter 4 is connected to a downstream side in a sheet discharging direction of the MFP 1. Two sheet trays 5 and 6 are arranged in the inserter 4. An image-formed sheet or a sheet that cannot pass through the image forming apparatus can be inserted through the inserter 4.

A ring binder device 7 is connected on the further downstream side of the inserter 4, and a post-processor 8 is connected on the most downstream side. The ring binder device 7 executes a punching process in which multiple punching holes are formed on the sheets of the booklet subjected to ring binding. Subsequently, the ring binder device 7 aligns the sheets and binds the sheets using rings. A detailed explanation of functions of the post-processor 8 is omitted. However, the post-processor 8 is a commonly known device that embeds a punching device of one to four holes and a stapling device for executing various types of staple binding and sheet alignments.

Figure 2:
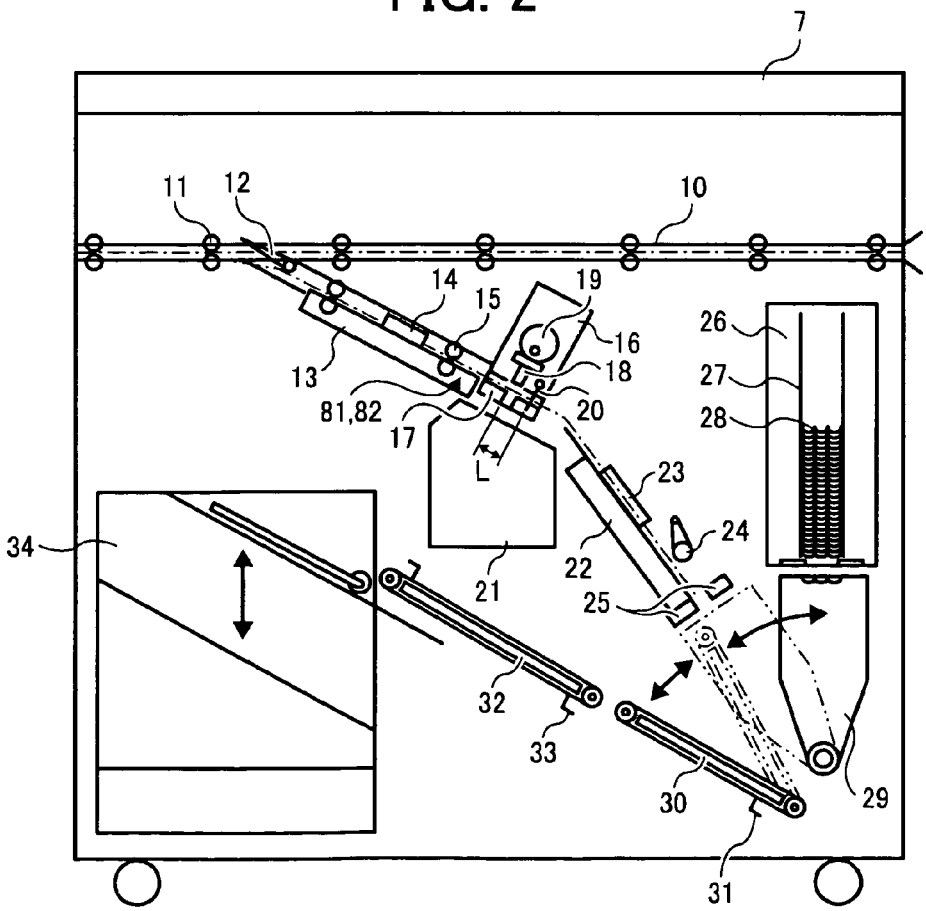
FIG. 2 is a schematic diagram for explaining an internal structure of a ring binder device shown in FIG. 1.

FIG. 2 is a schematic diagram for explaining an internal structure of the ring binder device 7. The ring binder device 7 is a so-called on-line ring binding device. A configuration, operations, and functions of the ring binder device 7 are sequentially explained below.

The ring binder device 7 includes, along a transportation path, a horizontal transportation path 10, alignment trays 13 and 22, a stack transporting unit 30, a last-stack transporting unit 32, and a stack tray 34. The ring binder device 7 also includes clamps 25 to hold a ring and a ring binding unit 29. The sheet fed from a main body of the image forming apparatus is transported through the horizontal transportation path 10 of the ring binder device 7. If the sheets are not bound using the rings, by horizontally transporting the sheets, the sheets are transported to the post-processor 8 on the downstream side. If the sheets are bound using the rings, the sheets are switched back by reverse rollers 11 that are on the downstream side of the horizontal transportation path 10. When the sheets are switched back, the sheets are transported to a punching unit, which is arranged diagonally on a lower side, by switching a switching claw 12. A plurality of transportation roller pairs are arranged on a sheet transportation path that includes the horizontal transportation path 10 and the sheet is transported along the sheet transportation path.

In the punching unit, an end portion of the sheet, which is in a parallel direction (hereinafter, called "horizontal direction") to the sheet transportation direction, is arranged on the alignment tray 13 using a jogger 14 that contacts the sheet end portion from a direction nearly orthogonal to the transportation direction. A lead edge portion of the sheet in the transportation direction strikes a lead-edge striking stopper 20 that is projected in the transportation path of the alignment tray 13. Thus, a position of the lead edge of the sheet in the transportation direction is decided. In other words, the horizontal direction and the transportation direction (vertical direction) of the sheet are decided by using the alignment tray 13 and the lead-edge striking stopper 20. When the sheet strikes the lead-edge striking stopper 20, transportation power is assigned to the sheet by using transportation rollers 15 having a torque limiter. Due to this, damage to a sheet lead edge is eliminated.

When the sheet is positioned, a cam 19 inside a punching unit 16 rotates and by pressing a punch 18, the holes are punched on the sheet in a line between the punch 18 and a die 17 at a predetermined interval. A position of the punching holes is at a distance L from the lead-edge striking stopper 20. The punching unit 16 is a multi-hole punch for ring binding. Upon finishing punching of ring holes, the sheet is set back from the transportation path of the lead-edge striking stopper 20. Subsequently, a contact status is released and the sheet is further transported to the downstream side. Punched chips generated due to hole punching are stored in a punched chip hopper 21.

Next, the sheets are transported to an aligning unit. In the aligning unit, the sheets forming the booklet are received one by one, aligned, and loaded onto the alignment tray 22. The alignment tray 22 includes a horizontally aligned jogger 23 and a beating roller 24 that pushes the sheet in the transportation direction of the sheet. The transportation direction (vertical direction) of the sheet is aligned towards a fence (not shown) and the horizontal direction is aligned according to the jogger 23.

The sheets forming the booklet are loaded onto the alignment tray 22. After the sheets are aligned, a binding-side proximity of the sheet is held by pressure using the clamps 25. A ring cartridge holder 26 is arranged in the vicinity of the alignment tray 22 and a ring cartridge 27 is set inside the ring cartridge holder 26. A plurality of rings 28 are stacked inside the ring cartridge 27. In the present embodiment, commonly known plastic rings having a circumference split into three portions are used.

The sheets subjected to binding are loaded onto the alignment tray 22. After the sheets are aligned, the ring binding unit 29 turns towards a lower portion of the ring cartridge 27 to pick up the rings. The ring binding unit 29 picks up a single ring, turns towards a downward side of the clamps 25 by holding the ring, and passes the ring through the hole punched on a lower end of the sheet stack. The ring binding is carried out using a binding mechanism (not shown) after the rings are passed through the punching holes. After the stack transporting unit 30, which is to be turned, is moved towards the downward side of the clamps 25, the clamps 25 are released and the ring bound booklet is received using a releasing claw 31 that is arranged on a belt of the stack transporting unit 30. Next, the ring bound booklet is transferred to the stack transporting unit 30.

Subsequently, the stack transporting unit 30 turns in an anticlockwise direction and moves up to a position until the stack transporting unit 30 becomes nearly linear with respect to the last-stack transporting unit 32. The booklet is transferred up to the last-stack transporting unit 32 using the releasing claw 31 that is arranged on the belt of the stack transporting unit 30. Subsequently, the booklet is transported from the last-stack transporting unit 32 using a releasing claw 33 that is arranged on a belt similarly as the releasing claw 31 that is arranged on the belt of the stack transporting unit 30. The booklet is discharged in the stack tray 34. The stack tray 34 ascends or descends depending on a stack quantity.

Figure 10:
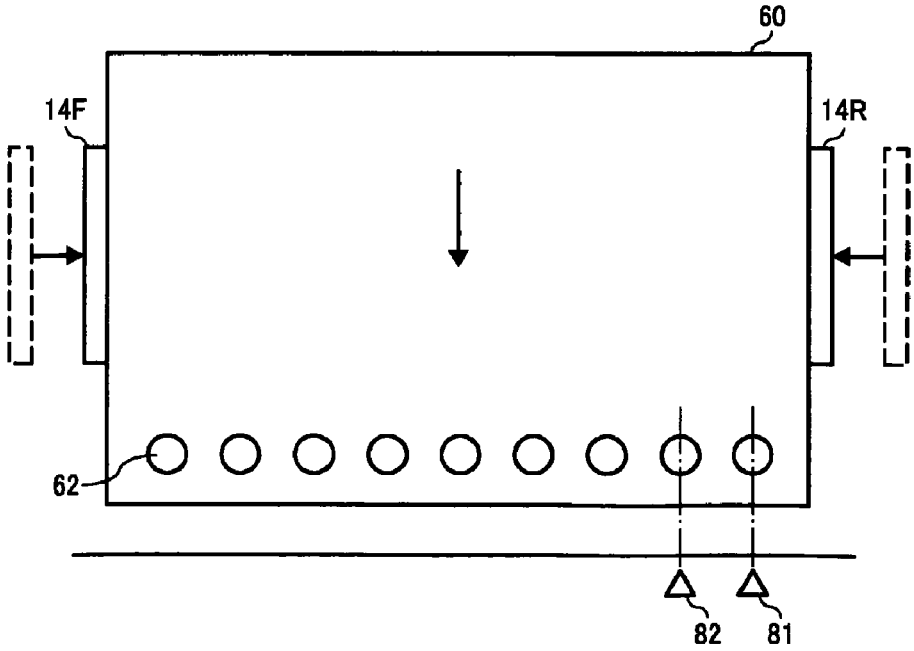
FIG. 10 is a schematic diagram for explaining a relation of ring holes of the sheet according to the first embodiment.

As shown in FIG. 10, in the first embodiment, punched-hole detecting sensors 81 and 82, for example reflective photo-sensors, are arranged for detecting a sheet size and the ring holes (punching holes) for binding the rings. Because the punched-hole detecting sensors 81 and 82 identify the sheets of an A4 size and a letter size, the punched-hole detecting sensors 81 and 82 are arranged on a position from where two outside holes, of the A4 size sheet, such as ring holes 40-1 and 40-2 are detected. In the first embodiment, the punched-hole detecting sensors 81 and 82 are at an upstream side of the sheet transportation direction of the punching unit 16 that is shown in FIG. 2. The punched-hole detecting sensors 81 and 82 are arranged in the vicinity of the punching unit 16 in a direction orthogonal to the sheet transportation direction. However, the position of the punched-hole detecting sensors 81 and 82 is not restricted to the position shown in FIG. 2. The punched-hole detecting sensors 81 and 82 can be arranged at a position, which is on the upstream side of the sheet transportation direction compared to the arrangement position of the punching unit 16, and at which the position of the sheet is aligned in the horizontal direction.

The punching holes are detected after sheets 60 are transported to the punching unit and a width direction (horizontal direction) is aligned according to a front jogger 14F and a rear jogger 14R shown in FIG. 10. In other words, the sheets 60 are transported to the punching unit after the width direction of the sheets 60 is aligned according to the joggers 14F and 14R. The punched-hole detecting sensors 81 and 82, which are adjusted to punching holes 62 for ring binding, detect presence of the holes at a transportation destination. The present embodiment is explained by assuming multiple punching holes of transverse feed of the A4 size and the letter size (LT). However, by changing a sensor position, a number of sensors, or a sensor type, various types of sheet sizes for multiple purposes and a hole mode can be easily handled. If a punched-hole detecting unit is arranged in the transportation path that is on the upstream side compared to the punching unit 16 and if the punched-hole detecting unit is embedded in the main body of the image forming apparatus such as the MFP 1 or in any processing device among other processing devices, similar functions can be realized.

The two punched-hole detecting sensors 81 and 82 can handle the sheet size and the hole mode due to the reasons mentioned below. For example, if the punching unit 16, which punches 23 ring holes on the A4 size sheet, punches the holes on the letter size similarly as on the A4 size sheet, 21 holes are punched on the letter size. In other words, compared to the A4 size sheet, two holes are less at edges of the letter size sheet on which the ring holes are formed. The two punched-hole detecting sensors 81 and 82 detect the holes at the position of the two holes on one side of the sheet edge on which the ring holes are formed. If the two holes can be detected, the sheet size is the A4 size and if only one hole can be detected, the sheet size is the letter size. On the other hand, if no hole cannot be detected, it is understood that the size of a sheet is smaller than the A4 size and the letter size. Thus, the sheet can be a B5 size sheet or an A5 size sheet.

If the ring holes are prior punched on the sheet, the ring holes can be detected by arranging a sensor in the middle of the horizontal transportation path 10. In the present embodiment, a reflective-type sensor detects the presence of the ring holes at a portion of a switch back unit where the sheet stops, and determines the ring holes based on detection results. In a bookbinding system according to the present embodiment, selection of a size of the ring binding sheet and a type (size) of a ring member, or settings can be input from the operation panel 3. In the present embodiment, the inserter 4, the ring binder device 7, and the post-processor 8 are connected to the downstream side in the sheet discharging direction of the MFP 1. Among the MFP 1, the inserter 4, the ring binder device 7, and the post-processor 8, at least the MFP 1, the ring binder device 7, and the post-processor 8 are on-line connected. A status of the MFP 1, the ring binder device 7, and the post-processor 8 is shown in FIG. 3.

Figure 3:
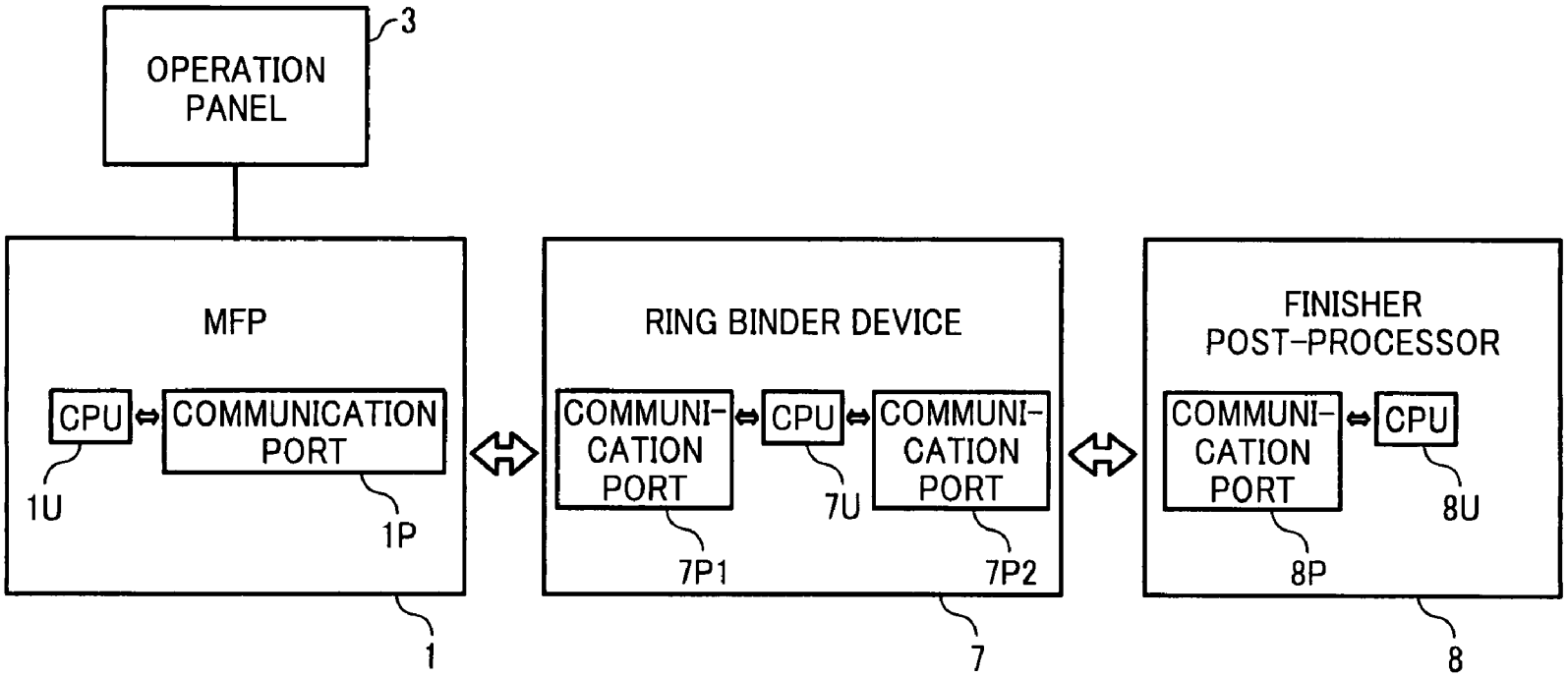
FIG. 3 is a block diagram of an on-line control structure of the bookbinding system shown in FIG. 1.

FIG. 3 is a block diagram of an on-line control structure of the bookbinding system shown in FIG. 1. In other words, in the on-line bookbinding system, the ring binder device 7 is connected to the MFP 1 and the post-processor (a finisher) 8 is connected to the ring binder device 7. The MFP 1, the ring binder device 7, and the post-processor 8 respectively include central processing units (CPU) 1U, 7U, and 8U and communication ports 1P, 7P1, 7P2, and 8P. The MFP 1 and the ring binder device 7 can mutually communicate through the communication ports 1P and 7P1 and the ring binder device 7 and the post-processor 8 can mutually communicate through the communication ports 7P2 and 8P. The operation panel 3 is connected to the MFP 1 using an interface (I/F) (not shown). Based on display instructions from the CPU 1U of the MFP 1, display is executed that is explained later. A user carries out operation input with respect to the MFP 1 by key input from the operation panel 3.

Similarly as the CPU 1U, 7U, and 8U, which are respectively installed in the MFP 1, the ring binder device 7, and the post-processor 8, a read only memory (ROM) is also respectively installed in the MFP 1, the ring binder device 7, and the post-processor 8. The CPU 1U, 7U, and 8U respectively read a program code stored in the respective ROM and expand in a random access memory (RAM). The CPU 1U, 7U, and 8U use the RAM as a work area and execute a computer program specified in the program code. Thus, a display control or processes are carried out that are explained later. The MFP 1, the ring binder device 7, and the post-processor 8 are electrically and serially connected via the communication ports 1P, 7P1, 7P2, and 8P. The MFP 1, the ring binder device 7, and the post-processor 8 are also mechanically and serially connected in a linear format (inline format) at least via the horizontal transportation path 10. When the process is on-line, the ring binder device 7 and the post-processor 8 communicate with the CPU 1U of the MFP 1 and are controlled by the CPU 1U of the MFP 1. In the present embodiment, inline signifies that the processes such as an image forming process, the punching process, a ring binding process, or the post process are executed during the flow of a single sheet.

Figure 7:
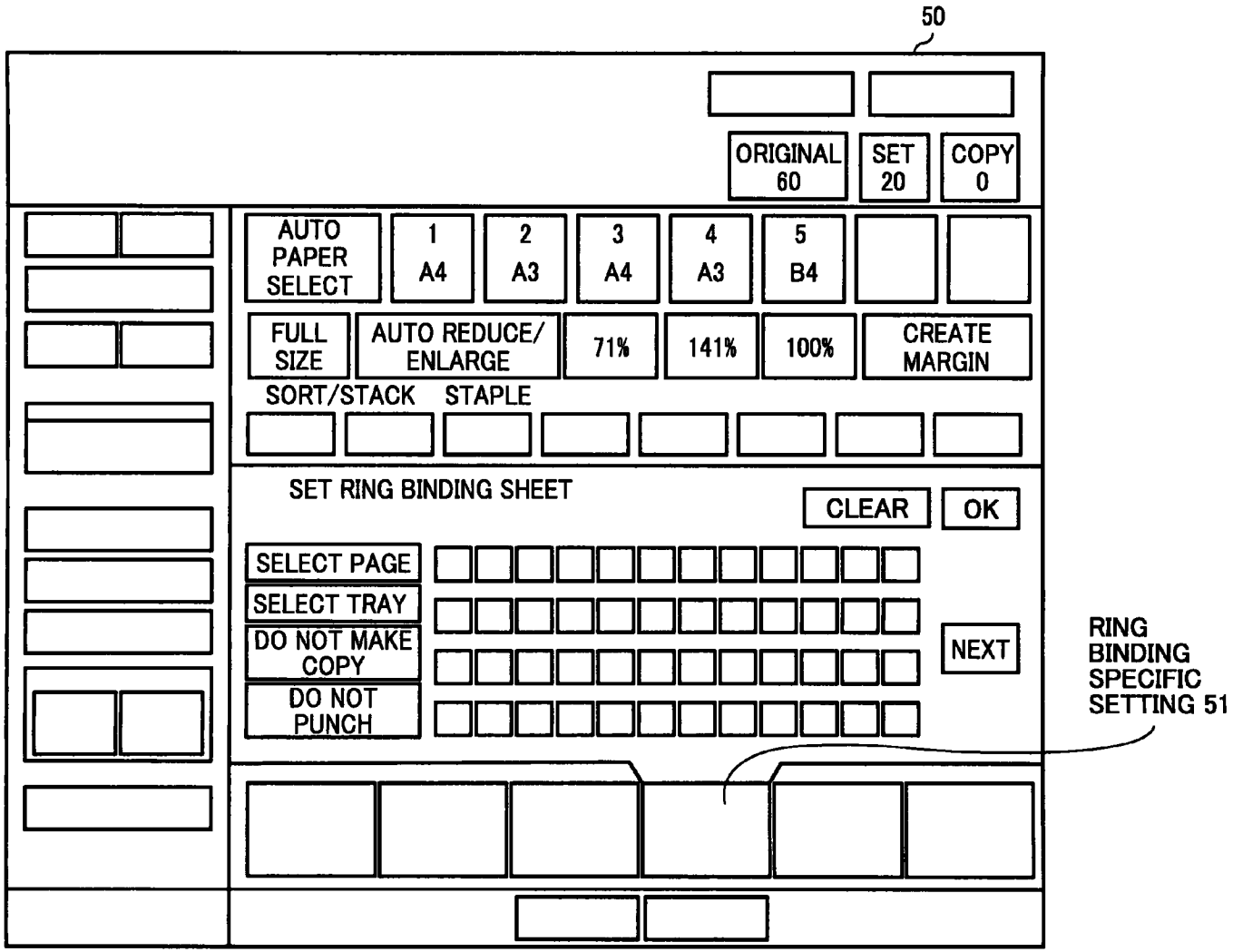
FIG. 7 is a schematic diagram in which a display status of a liquid-crystal display screen of an operation panel and a special setting screen of ring binding is indicated.
Figure 8:
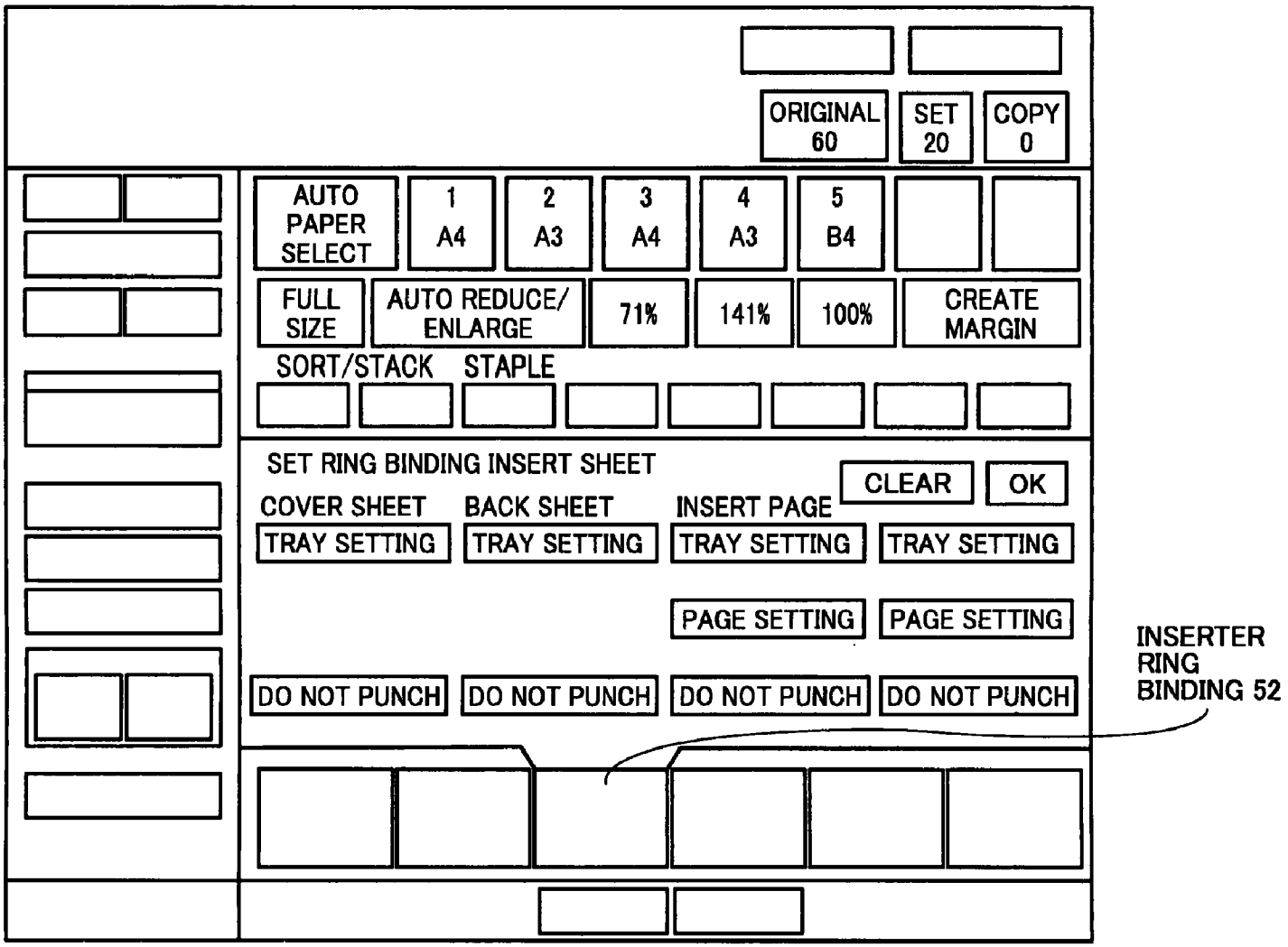
FIG. 8 is a schematic diagram in which the display status of the liquid-crystal display screen of the operation panel and a setting screen of a sheet for inserting from an inserter is indicated.

FIGS. 7 and 8 are schematic diagrams in which a display status of a liquid-crystal display screen 50 of the operation panel 3 is indicated. A special setting screen in ring binding is shown in FIG. 7. An operating screen changes by touching a tab 51 on a lower portion. Due to this, the special setting screen is obtained. A setting of a sheet feeding tray for each page in ring binding, a setting indicating whether to make a copy, and a setting indicating whether to punch can be carried out on the special setting screen. Thus, the sheet feeding tray, which includes the loaded sheets having the punching holes, can also be specified from the special setting screen.

A setting screen of a sheet, which is to be inserted from the inserter 4, is shown in FIG. 8. The operating screen changes on the setting screen by touching a tab 52 that is on a lower portion. Due to this, the sheet setting screen is obtained. A setting of punch release and an insertion page for the sheet to be inserted from the inserter 4 can be carried out on the setting screen. Thus, the inserter 4 also operates on-line with respect to the MFP 1 on the setting screen.

Figure 9:
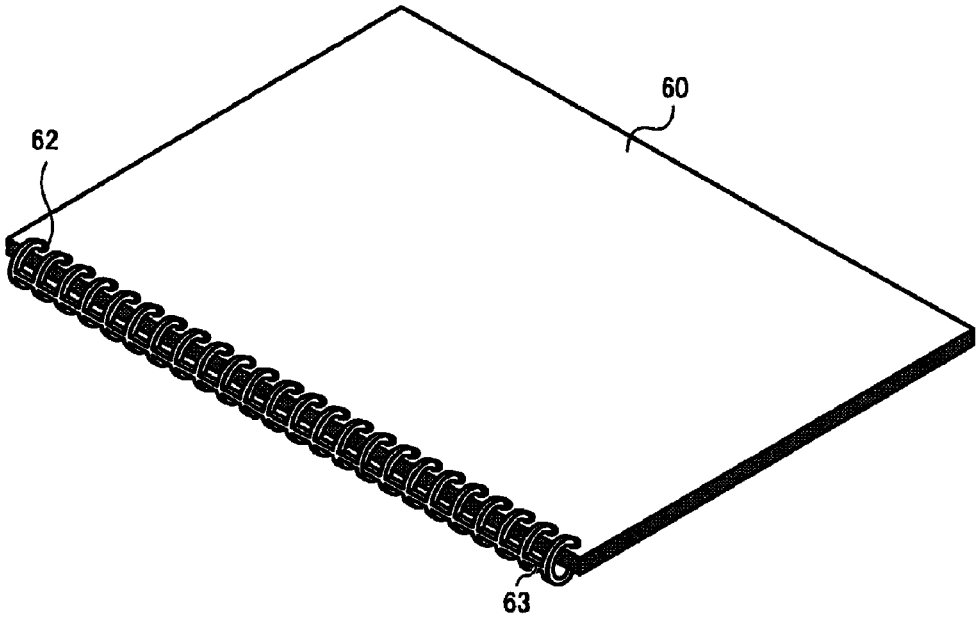
FIG. 9 is a schematic diagram of a ring bound booklet created using the bookbinding system according to the first embodiment.

FIG. 9 is a schematic diagram of a ring bound booklet created using the bookbinding system shown in FIG. 1. As shown in FIG. 9, a plurality of punching holes 62 is punched in the vicinity of the end portion of the sheets 60. The sheets 60 are bound using rings 63 to form the booklet. In the present embodiment, using the ring binding unit 29, the rings 63 are fixed to the sheets that are transported from the MFP 1 and on which the punching holes (ring holes) 62 are prior punched and the rings 63 are also fixed to the sheets on which the punching holes (ring holes) 62 are formed using the punching unit 16 and ring bound bookbinding is carried out.

Figure 4:
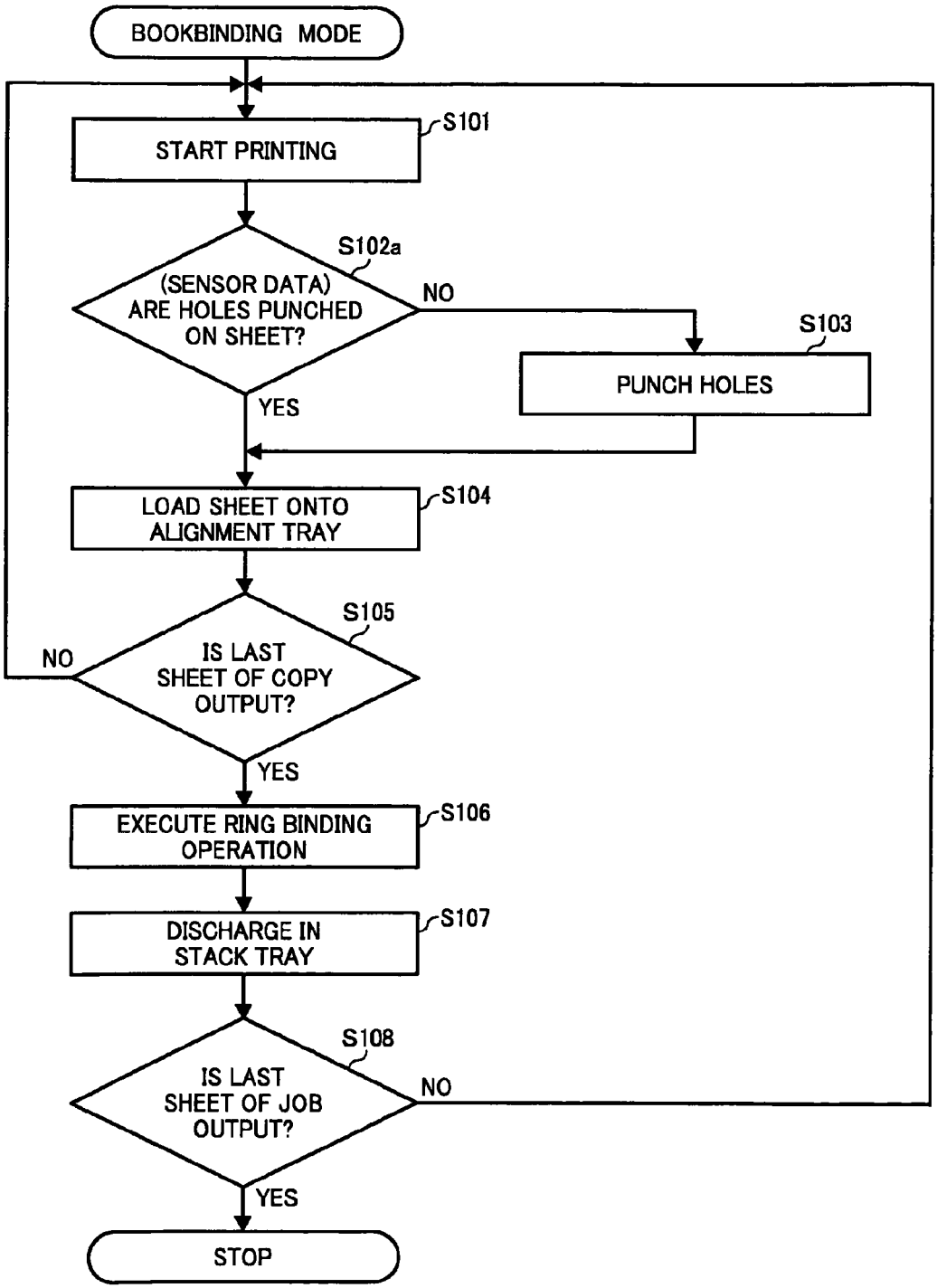
FIG. 4 is a flowchart for explaining an example of a processing sequence according to the first embodiment.

FIG. 4 is a flowchart for explaining a sequence of operations performed by the ring binder device 7 in a ring binding mode. For executing the operations mentioned below, the CPU 1U, which is a control device installed in the MFP 1, reads the program code stored in the ROM (not shown) and executes the computer program defined in the read program code by using the RAM (not shown) as the work area.

Upon starting a printing operation (Step S101), the punched-hole sensors 81 and 82 detects whether the punching holes 62 are punched on the binding-side end portion of the sheet (Step S102*a*). If the punching holes 62 are already punched on the sheet (Yes at Step S102*a*), the CPU 1U transmits to an off-line punching device or the on-line ring binder device 7, instruction signals for not punching the punching holes 62. Thus, the punching operation is not carried out. However, if the punching holes 62 are not punched (No at Step S102*a*), the CPU 1U instructs the off-line punching device or the on-line ring binder device 7 to punch the punching holes 62 (Step S103). Next, the sheet having the punched punching holes 62 is loaded onto the alignment tray 22 (Step S104). The operation of loading the sheet onto the alignment tray 22 is repeated until the last sheet of a copy is output (Yes at Step S105), the sheet stack is sent to the ring binding unit 29 and the ring binding unit 29 executes the ring binding operation (Step S106). The ring bound sheet stack is discharged in the stack tray 34 (Step S107). The operations at Steps S101 to S107 are repeated until the discharged sheet of the sheet stack is the last sheet (last copy) of a job. The process ends when the last sheet (last copy) of the job is discharged (Step S108).

The CPU 1U of the MFP 1 does not directly control the off-line punching device. In the present embodiment, the off-line punching device operates based on instructions from the CPU 7U of the on-line ring binder device 7.

Even if the punched-hole detecting sensors 81 and 82 are arranged at any positions that are between the MFP 1 and the off-line punching device or the punching unit 16 inside the ring binder device 7, the functions performed by the punched-hole detecting sensors 81 and 82 are the same. Thus, even if the sheet having the prior punching holes is used, double punching is prevented. At the time of inserting from the inserter 4, a cover sheet and a back cover on which the image forming is not carried out using the MFP 1, prior punching using the off-line punching device enables to insert the rings into the booklet even for thick sheets or a plastic film that cannot be punched using an inline punch (punching unit 16). A punched-hole detecting process is explained later.

Figure 5:
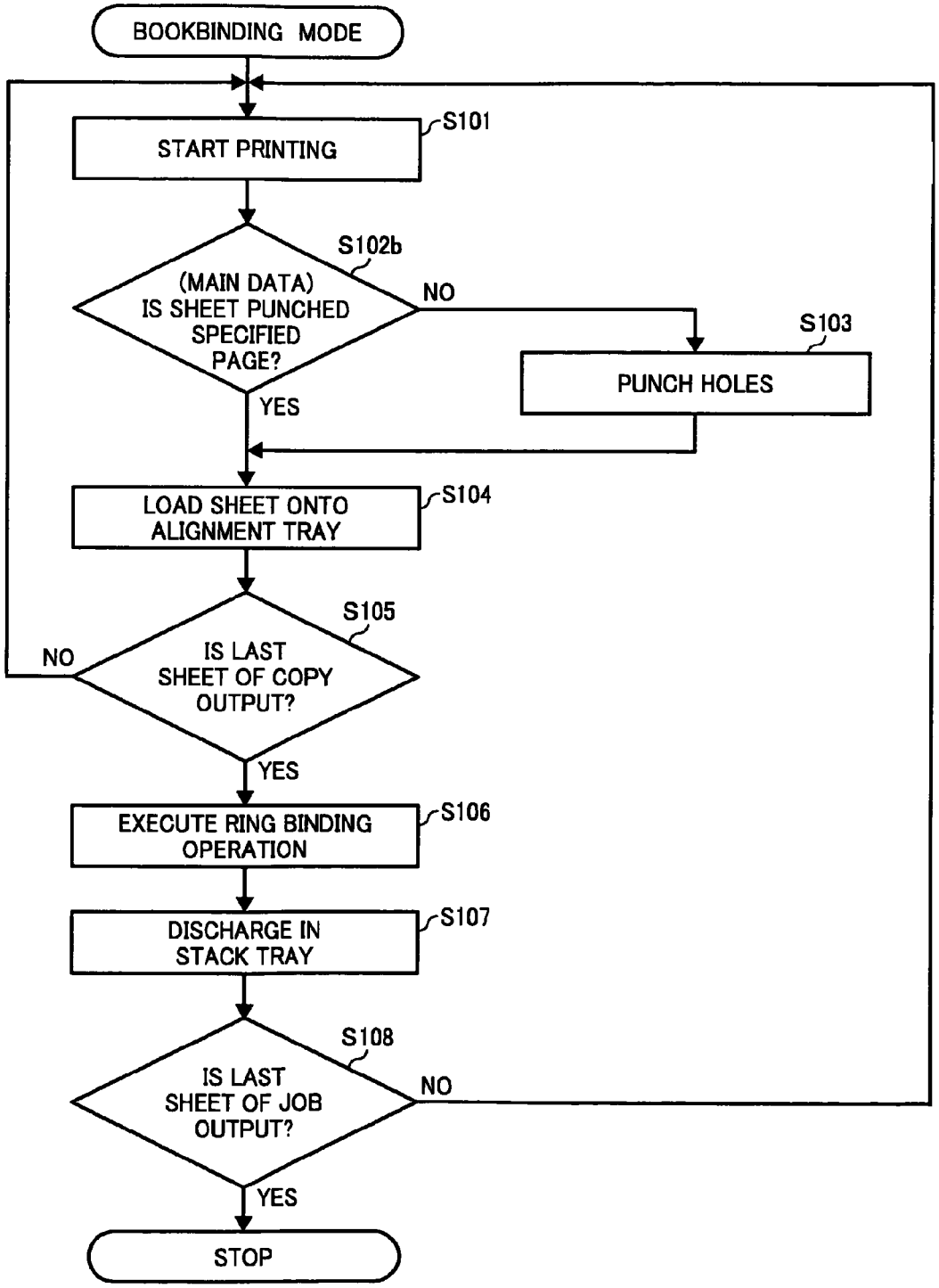
FIG. 5 is a flowchart for explaining another example of a processing sequence according to the first embodiment.

In a flowchart of an operation shown in FIG. 5, the user specifies from the operation panel 3, a page of the sheet having the prior punching holes. The user transmits the instruction signals to the off-line punching device or the on-line ring binder device 7 indicating not to punch the holes on the sheet having the prior punching holes, thus not carrying out the punching operation. Step S102*a*, which is indicated in FIG. 4, is substituted by Step S102*b* shown in FIG. 5.

Whether the sheet is the punched specified page is determined at Step S102*b* based on data from the MFP 1. If the sheet is the punched specified page (Yes at Step S102*b*), the sheet is loaded onto the alignment tray 22 (Step S104). If the sheet is not the punched specified page (No at Step S102*b*), the holes are punched on the sheet (Step S103) and the sheet is loaded onto the alignment tray 22 (Step S104). Because the other operations are the same, redundant explanation is omitted.

Thus, double punching is prevented even if the sheet having the prior punching holes is used. At the time of inserting from the inserter 4, the cover sheet and the back cover on which the image forming is not carried out using the MFP 1, if correspondence is established between pages of the booklet and the punched specified pages, prior punching using the off-line punching device enables to insert the rings into the booklet even for the thick sheets or the plastic film that cannot be punched using the inline punch (punching unit 16).

Figure 6:
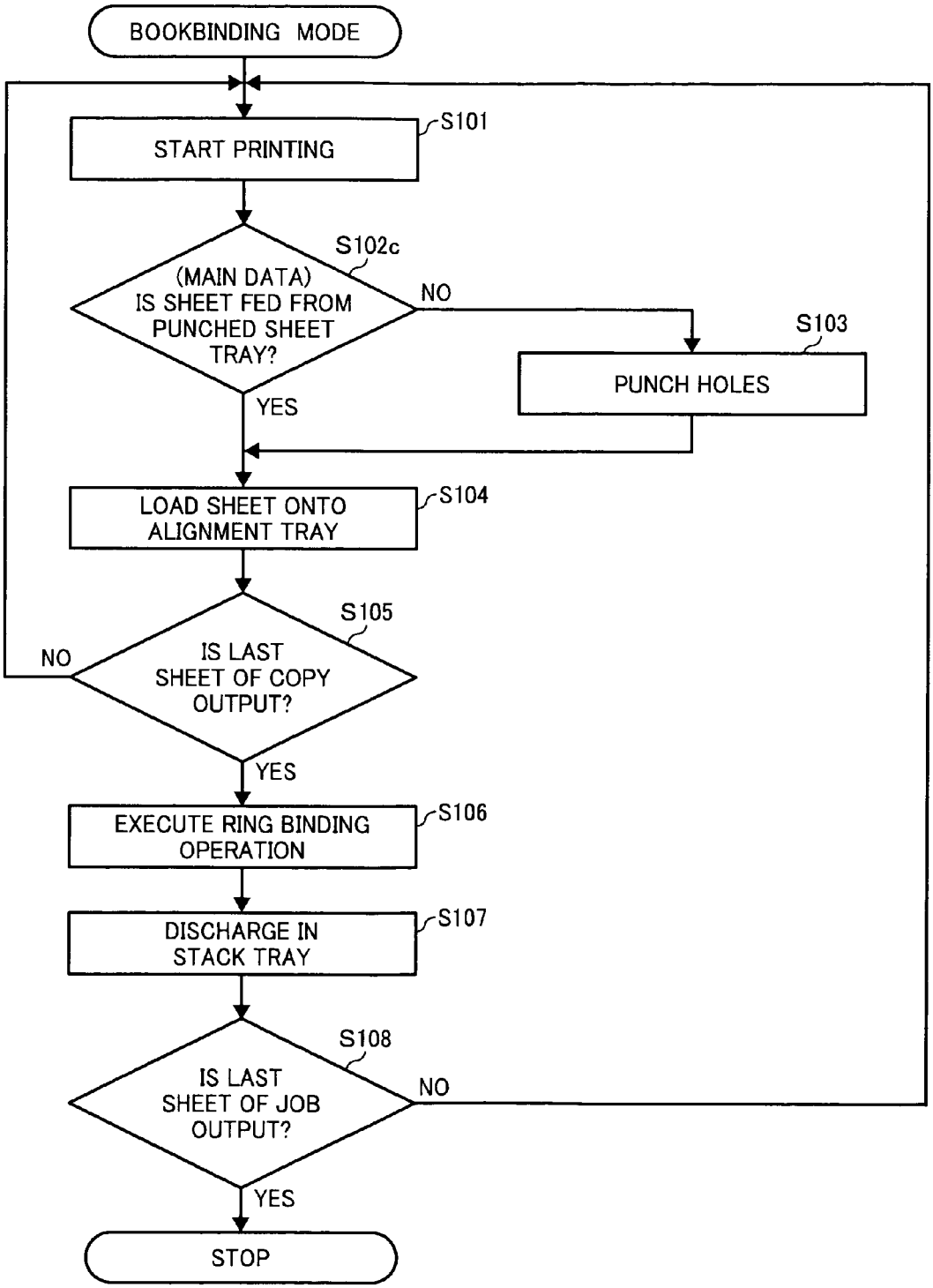
FIG. 6 is a flowchart for explaining still another example of a processing sequence according to the first embodiment.

In a flowchart of an operation shown in FIG. 6, the user specifies from the operation panel 3, a sheet feeding tray in which the sheets having the prior punching holes are set and transmits the instruction signals to the off-line punching device or the on-line ring binder device 7 such that the holes are not punched on the sheet fed from the sheet feeding tray, thus not performing the punching operation. Step S102*a*, which is indicated in FIG. 4, is substituted by Step S102*c* shown in FIG. 6.

Whether the sheet is fed from a punched sheet tray is determined at Step S102*c* based on data from the MFP 1. If the sheet is fed from the punched sheet tray (Yes at Step S102*c*), the punched sheet is loaded onto the alignment tray 22 (Step S104). If the sheet is not fed from the punched sheet tray (No at Step S102*c*), the holes are punched on the sheet (Step S103) and the sheet is loaded onto the alignment tray 22 (Step S104). Because the other operations are the same, redundant explanation is omitted.

Thus, double punching is prevented even if the sheet having the prior punching holes is used. At the time of inserting from the inserter 4, the cover sheet and the back cover on which the image forming is not carried out using the MFP 1, if correspondence is established between the pages of the booklet and a number of the sheet feeding tray, prior punching using the off-line punching device and setting the sheets in the specified sheet feeding tray enables to insert the rings into the booklet even for the thick sheets or the plastic film that cannot be punched using the inline punch.

Figure 11:
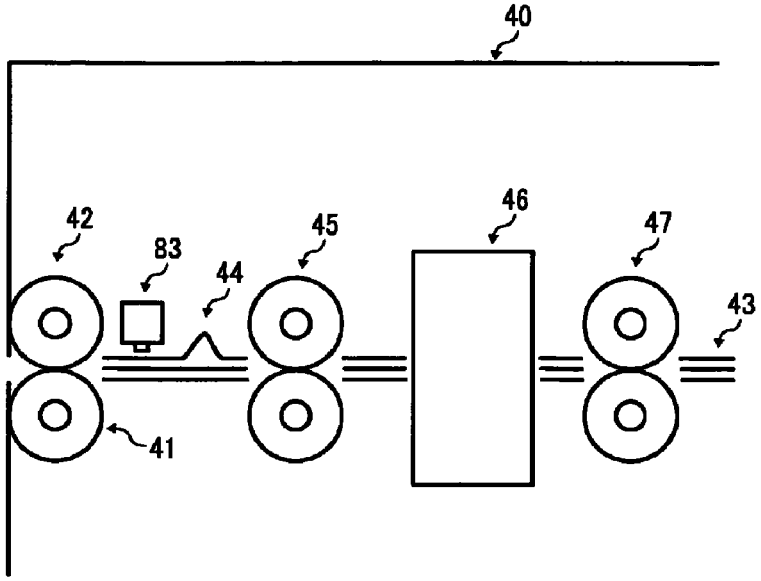
FIG. 11 is a schematic diagram for explaining a detailed structure of an off-line punching device according to a second embodiment of the present invention.

In a second embodiment of the present invention, the punching device is set as off-line. FIG. 11 is a schematic diagram of the off-line punching device according to a second embodiment that punches the holes. A punching device 40 is arranged on the upstream side in the sheet transportation direction of the ring binder device 7 (not shown). The punching device 40 is not directly controlled by the CPU 1U of the MFP 1. The punching device 40 operates by receiving control signals from another device connected on-line to the MFP 1. If the present embodiment is related to the first embodiment, the punching unit shown in FIG. 2 is omitted in the present embodiment and the punching device 40 is used as the substitute for the punching unit. The punching device 40, which is arranged between the inserter 4 and the ring binder device 7, communicates with the ring binder device 7 and operates based on instruction signals from the ring binder device 7. Furthermore, because various units, which are not particularly explained, include the same structure as the structure in the first embodiment and function similarly the units in the first embodiment, redundant explanation is omitted.

As shown in FIG. 11, a light reflecting-type punched-hole detecting sensor 83 is arranged on the downstream side in the sheet transportation direction of an entrance roller pair 41 and 42 of the punching device 40 and on the upstream side of registration rollers 45. The registration rollers 45 are arranged on the upstream side in the sheet transportation direction of a punching unit 46. While punching the holes, the lead edge of the sheet comes into contact with a nip and is likely to bend. Thus, the registration rollers 45 include a function that aligns the lead edge of the sheet in a direction orthogonal to the sheet transportation direction. Furthermore, transportation rollers 47, which transport the sheet that has passed through the punching unit 46, are arranged on the downstream side in the sheet transportation direction of the punching unit 46 to transport the sheet along a transportation path 43.

Thus, the punched-hole detecting sensor 83 in the off-line punching device 40 detects the punching holes and decides whether to carry out the punching operation based on first to fifth examples of processes indicated in flowcharts shown in FIGS. 12 to 16. For executing the processes, a CPU (not shown) of the off-line punching device 40 reads a program code stored in a ROM. The CPU uses a RAM (not shown) as a work area and executes a computer program defined in the read program code. Similarly as the punched-hole detecting sensors 81 and 82 according to the first embodiment, the punched-hole detecting sensor 83 is respectively arranged on punched positions of two holes or three holes that are at the end portion of the sheet.

Figure 12:
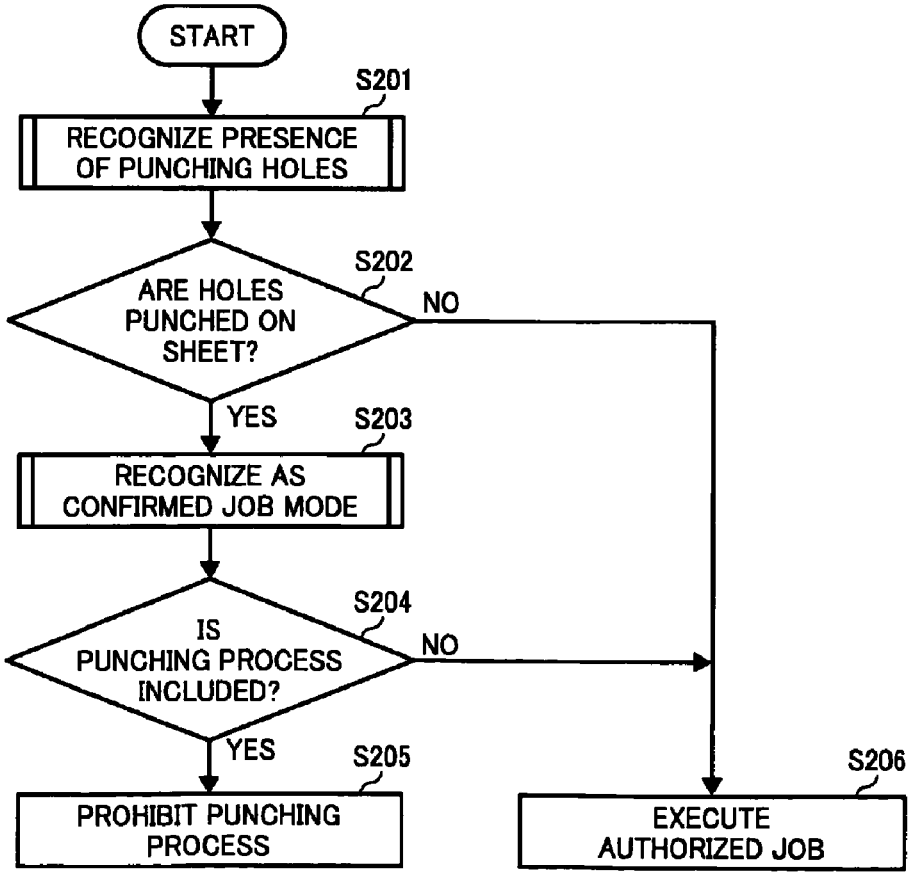
FIG. 12 is a flowchart of an example of a process sequence according to the second embodiment.

In the first example of the process shown in FIG. 12, first, a presence of the punching holes is recognized (Step S201). If the holes are not punched on the sheet (No at Step S202), a job, which includes a punching process and is authorized, is executed (Step S206). If the holes are punched on the sheet (Yes at Step S202), a recognition process is executed for a confirmed job mode (Step S203). If the job mode does not include the punching process (No at Step S204), the job authorized at Step S206 is executed. If the job mode includes the punching process (Yes at Step S204), the punching process is prohibited (Step S205). If the punching process is prohibited at Step S205, the process for loading the sheet onto the alignment tray 22 at Step S104 is executed. If the job authorized at Step S206 is to be executed, the process of punching the holes at Step S103 and subsequent processes are executed. The first example of the process corresponds to a process that is based on a result obtained upon determining whether the holes are punched on the sheet at Step S102*a* shown in FIG. 4.

Figure 13:
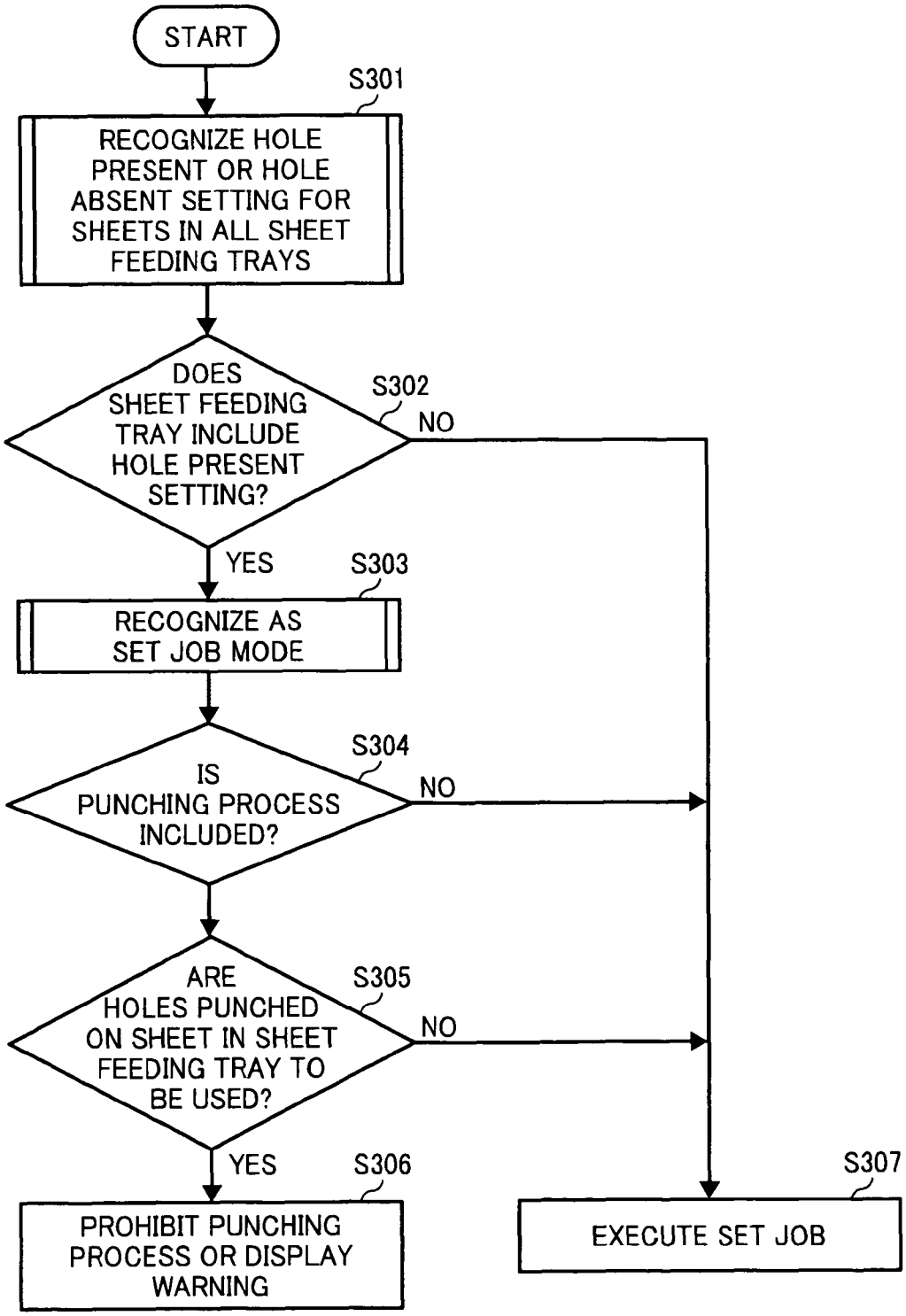
FIG. 13 is a flowchart of another example of a process sequence according to the second embodiment.

In the second example of the process that is shown in FIG. 13, whether a hole present or a hole absent setting is carried out with respect to the sheets in all the sheet feeding trays is recognized (Step S301). If the sheet feeding tray includes a hole present setting (Yes at Step S302), the recognition process for the set job mode is executed (Step S303). Whether the job includes the punching process is checked (Step S304). If the job includes the punching process, it is further checked whether the sheet in the sheet feeding tray that is to be used includes the punching holes (Step S305). If the sheet includes the punching holes, the punching process is prohibited or a warning to the effect that the sheet includes the punching holes is displayed on the operation panel 3 (Step S306).

However, if the sheet feeding tray does not include the hole present setting at Step S302, the punching process is not included at Step S304, and the sheet in the sheet feeding tray to be used does not include the punching holes at Step S305, a currently set job is executed at Step S307. If the punching process is prohibited at Step S306, the process for loading the sheet onto the alignment tray 22 at Step S104 is executed. If the job authorized at Step S307 is to be executed, the process of punching the holes at Step S103 and subsequent processes are executed. The second example of the process corresponds to a process that is based on a result obtained upon determining whether the holes are punched on the sheet at Step S102*c* shown in FIG. 6.

Figure 14:
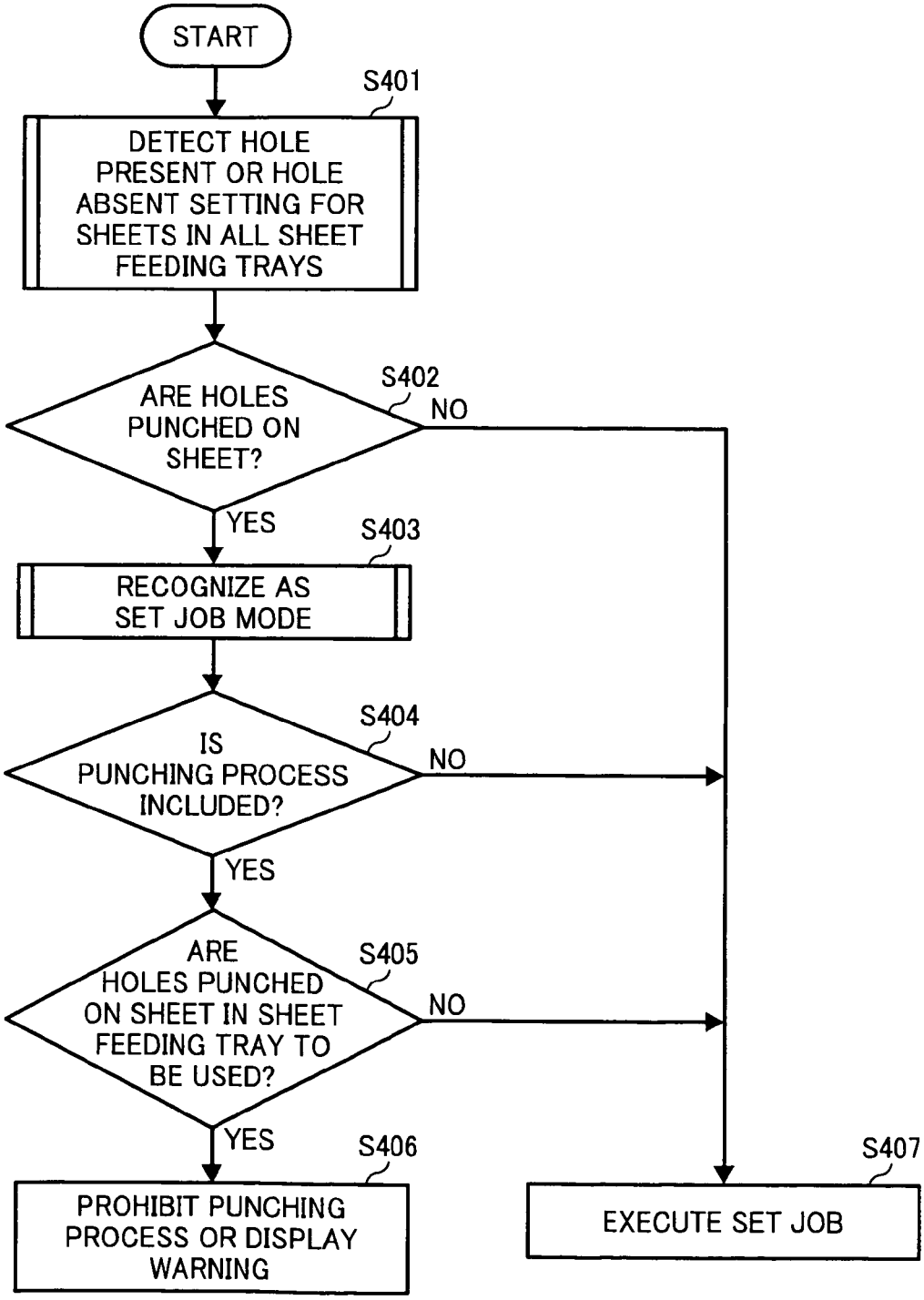
FIG. 14 is a flowchart of still another example of a process sequence according to the second embodiment.

In the third example of the process shown in FIG. 14, a detecting process is executed for detecting the hole present or the hole absent setting with respect to the sheets in all the sheet feeding trays (Step S401). If the holes are punched on the sheet (Yes at Step S402), the recognition process of the set job mode is executed (Step S403). Subsequently, whether the job includes the punching process is checked (Step S404). If the punching process is included, it is further checked whether the sheet in the sheet feeding tray that is to be used includes the punching holes (Step S405). If the sheet includes the punching holes, the punching process is prohibited or the warning to the effect that the sheet includes the punching holes is displayed on the operation panel 3 (Step S406).

However, if the sheet does not include the punching holes at Step S402, the punching process is not included at Step S404, and the sheet in the sheet feeding tray to be used does not include the punching holes at Step S405, a currently set job is executed at Step S407. If the punching process is prohibited at Step S406, the process for loading the sheet onto the alignment tray 22 at Step S104 is executed. If the job authorized at Step S407 is to be executed, the process of punching the holes at Step S103 and subsequent processes are executed. The third example of the process corresponds to a process that is based on a result obtained upon determining whether the holes are punched on the sheet at Step S102*b* shown in FIG. 5.

Figure 15:
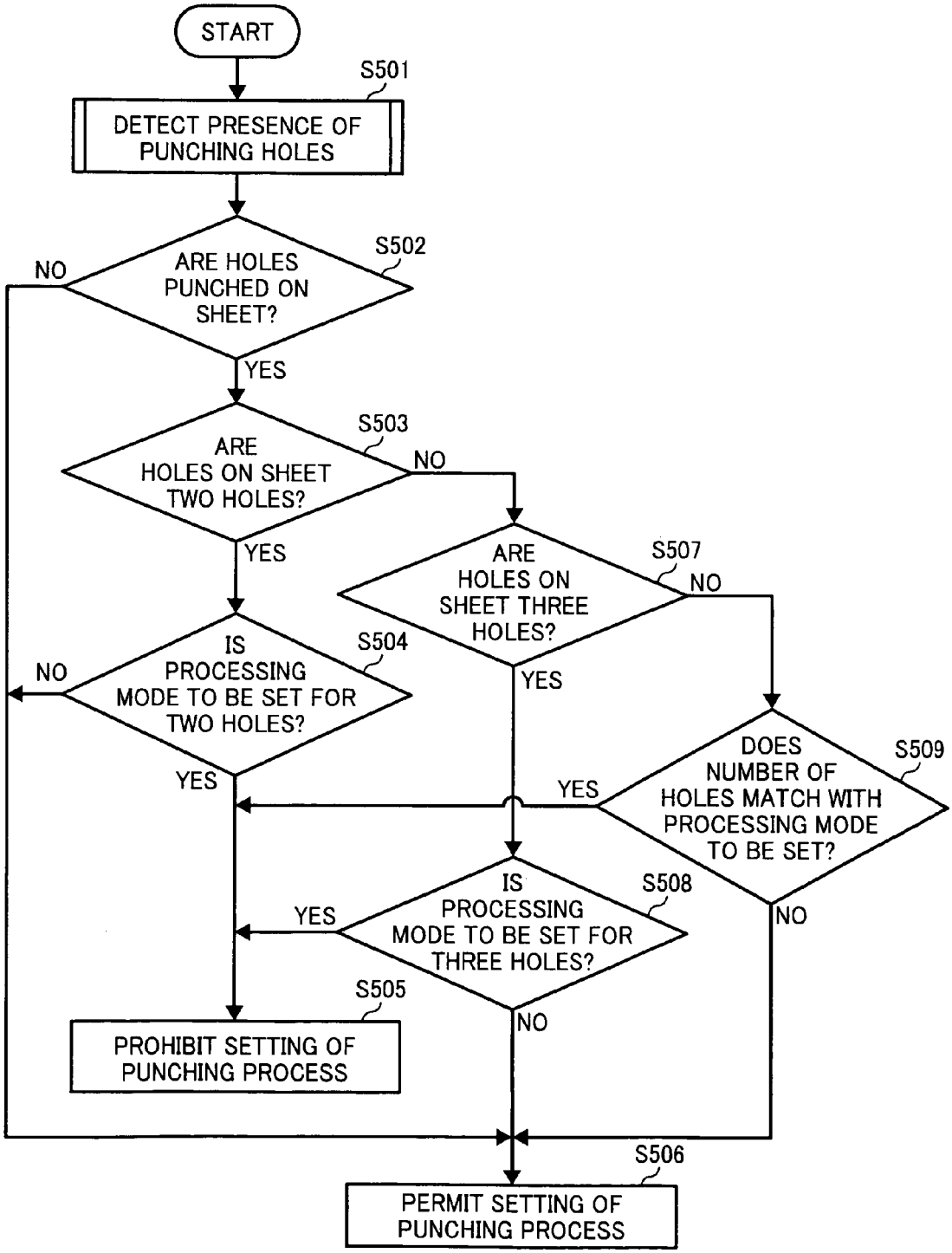
FIG. 15 is a flowchart of still another example of a process sequence according to the second embodiment.

In the fourth example of the process shown in FIG. 15, a process is executed based on whether the punching holes are multiple. In the processes, a punched-hole detecting process that detects whether the holes are punched on the sheet is executed first (Step S501). Based on a detection processing result, if the holes are punched on the sheet (Yes at Step S502), it is checked whether the punching holes are two holes or other than two holes (Step S503). If the detected punching holes are the two holes, it is further checked at Step S504 whether a processing mode to be set is a processing mode of the two holes. If the processing mode to be set is for the two holes (Yes at Step S504), because the two holes are already punched (Step S505), the setting of the punching process is prohibited.

However, if the holes punched on the sheet at Step S503 are not the two holes, it is further checked at Step S507 whether the punching holes are three holes. If the punching holes are the three holes, it is checked whether the processing mode to be set is a processing mode for the three holes (Step S508). If the processing mode is for the three holes, because the three holes are already punched (Step S505), the setting of the punching process is prohibited. However, if the punching holes are not the three holes at Step S507, a number of holes is matched with a processing mode to be set at Step S509. If the number of holes matches with the processing mode to be set, because punching of the holes is not required (Step S505), the setting of the punching process is prohibited. If the holes are not punched on the sheet at Step S502, the processing mode to be set is not for the two holes at Step S504, the processing mode is not for the three holes at Step S508, and the processing mode does not match with the processing mode at Step S509, setting of the respective punching process is permitted (Step S506).

If the setting of the punching process is permitted at Step S506 by executing the process for loading onto the alignment tray 22 at Step S104 when the punching process is prohibited at Step S505, the process of punching the holes at Step S103 and subsequent processes are executed. The fourth example of the process corresponds to a process that is based on a result obtained upon determining whether the holes are punched on the sheet at Step S102*a* shown in FIG. 4.

Figure 16:
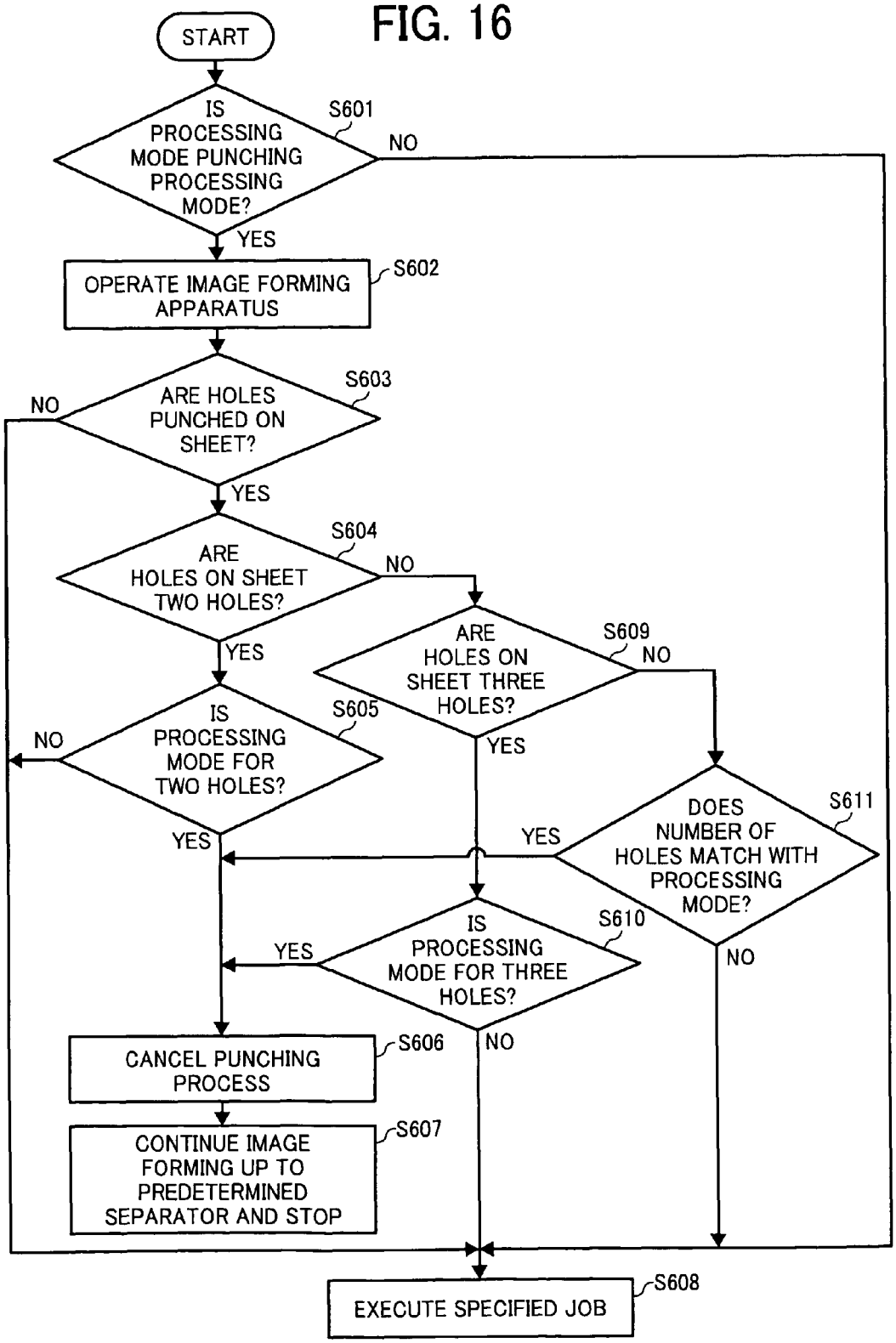
FIG. 16 is a flowchart of still another example of a process sequence according to the second embodiment.

In the fifth example of the process shown in FIG. 16, a process is executed by associating the punching process with an image forming operation. In the processing example, first, whether the processing mode is the punching processing mode is checked (Step S601). If the processing mode is the punching processing mode, image forming is carried out using the MFP 1 (Step S602). Subsequently, it is checked whether the holes are punched on the sheet (Step S603). It is further checked whether the punching holes are the two holes or other than the two holes (Step S604). If the detected punching holes are the two holes, it is further checked at Step S605 whether the processing mode to be set is the processing mode for the two holes. If the processing mode to be set is for the two holes (Yes at Step S605), because the two holes are already punched, the punching process is canceled (Step S606). Image forming is continued up to a predetermined separator and the image forming operation is stopped (Step S607).

However, if the holes punched on the sheet at Step S604 are not the two holes, it is further checked at Step S609 whether the punching holes are the three holes. If the punching holes are the three holes, it is checked whether the processing mode to be set is the processing mode for the three holes (Step S610). If the processing mode is for the three holes, because the three holes are already punched, the process transfers to the process at Step S606. However, if the punching holes are not the three holes at Step S609, it is checked at Step S611 whether the number of holes matches with the processing mode to be set. If the number of holes matches with the processing mode to be set, because punching of the holes is not required, the process transfers to the process at Step S606. If the processing mode is not the punching processing mode at Step S601, the holes are not punched on the sheet at Step S603, the processing mode to be set is not the processing mode for the two holes at Step S605, the processing mode is not the processing mode for the three holes at Step S610, and the number of holes does not match with the processing mode at Step S611, the job of the respective specification is executed (Step S608).

If the punching process is canceled at Step S606, the process for loading the sheet onto the alignment tray 22 at Step S104 is executed. If the processing mode is not the punching processing mode when the specified job is to be executed at Step S608, the specified job is executed in the set processing mode. If the processing mode is the punching processing mode, the process of punching the holes at Step S103 and subsequent processes are executed.

Effects obtained according to the embodiments of the present invention are explained below.

If the sheet having the prior punching holes is used, by giving instructions to the ring binder device 7 not to carry out punching on the sheet, punching of the holes can be avoided. Thus, even if the sheet having the prior punching holes is used, displacement of a hole position and widening of a hole diameter occurring due to double punching of the holes is prevented.

If the sheet having the prior punching holes is used, the MFP 1 can give instructions to the ring binder device 7 not to carry out punching on the sheet, thus avoiding punching of the holes. Due to this, the thick sheet or the plastic film that cannot be punched using the inline punching device can be inserted in the booklet that is to be ring bound. Thus, more multicolored and high quality bookbinding can be carried out.

If the ring binder device 7, which embeds the punching device, is instructed to detect using the punched-hole detecting sensors 81, 82, and 83, the punching holes on the sheet, and not to punch holes on the sheet that include the prior punching holes, a setting can be carried out such that the ring binder device 7 does not punch holes on the sheet. Thus, selection of punching can be easily carried out for each sheet. Even if the sheet having the prior punching holes is used, displacement of the hole position and widening of the hole diameter occurring due to double punching of the holes is prevented. Furthermore, the thick sheet and the plastic film on which punching is not possible using the inline punching device can be inserted in the booklet for ring binding. Thus, more multicolored and high quality bookbinding can be carried out.

By specifying the page of the sheet having the prior punching holes, the MFP 1 instructs the ring binder device 7 that includes the punching unit 16 not to carry out punching on the sheet of the specified page. Consequently, punching is not carried out on the sheet. Thus, even if the sheet having the prior punching holes is used, displacement of the hole position and widening of the hole diameter occurring due to double punching of the holes is prevented.

By specifying the sheet feeding tray in which the sheets having the prior punching holes are set, the MFP 1 instructs the ring binder device 7 that includes the punching unit 16 not to carry out punching on the sheet fed from the sheet feeding tray. Thus, even if depending on the sheet feeding tray, the sheet having the prior punching holes is used, displacement of the hole position and widening of the hole diameter occurring due to double punching of the holes is prevented.

The instructions are given to the punching device not to carry out punching on the sheet when the sheet having the prior punching holes is used. Thus, if the sheet having the prior punching holes is used, displacement of the hole position and widening of the hole diameter occurring due to double punching of the holes is prevented. Because the punched-hole detecting sensors 81, 82, and 83 detect the punching holes on the sheet, instructions can be given such that punching is not carried out on the sheet having the prior punching holes.

In the embodiments explained earlier, the sheets corresponds to a reference numeral 60, the punching holes correspond to a reference numeral 62, the punching unit corresponds to the punching unit 16, an aligning unit corresponds to the jogger 23, a ring binding unit corresponds to the ring binding unit 29, a ring-shaped binding tool corresponds to the rings 63, a bookbinding device corresponds to the ring binder device 7, a prohibiting unit corresponds to the CPU 7U in the ring binder device 7 or the CPU 1U of the MFP 1, a punching device corresponds to the punching device 40, the punched-hole detecting unit corresponds to the punched-hole detecting sensors 81, 82, and 83, a unit that specifies presence of the punching holes and a sheet size corresponds to the CPU 1U or the CPU 7U, and a sheet aligning unit corresponds to the jogger 14, 14F, and 14R.

The punching holes specified in the present document are the ring holes for mounting the rings for ring binding.

According to an aspect of the present invention, punching on a sheet is decided based on a presence of prior punching holes. Because punching is carried out only on the sheet on which prior punching is not carried out, regardless of the punching holes prior punched for the ring binding, a ring binding process can be effectively carried out for a sheet stack that is to be ring bound.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A bookbinding system comprising:

an image forming apparatus that forms an image on a sheet; and a bookbinding device that receives the sheet on which an image is formed by the image forming apparatus and includes a punching unit that performs a punching process of forming a punching hole on a sheet;

an aligning unit that aligns a plurality of sheets having punching holes;

a ring binding unit that mounts, in the punching holes of the sheets aligned by the aligning unit, a ring-shaped binding tool to create a booklet; and a prohibiting unit that, if a sheet received from the image forming apparatus is a punched sheet having a punching hole thereon, causes the punching unit not to perform the punching process on the punched sheet, the prohibiting unit further including a detecting unit to detect whether or not the sheet received from the image forming apparatus is a punched sheet and to determine the size of the sheet received from the image forming apparatus upon detecting that the sheet received from the image forming apparatus is a punched sheet, the detecting unit being arranged upstream of the punching unit in a sheet conveyance path, the detecting unit being arranged on a position wherefrom two adjacent punching holes, among multiple punching holes, can be detected on an end portion of the sheet, and the presence of the holes being detected and a sheet size being determined based on detection results of two punched-hole detection sensors of the detecting unit.

2. The bookbinding system according to claim 1, wherein, the determined sheet size is one of two types, and a total number of punching holes, formed in a line at the same pitch in a sheet of one of the two types, differs by two from the total number of punching holes in a sheet of the other of the two types.

3. The bookbinding system according to claim 1, wherein the detecting unit is arranged at a position wherefrom two or three holes in the punched sheet can be detected.

4. The bookbinding system of claim 1, wherein the two punched-hole detection sensors are arranged to detect adjacent punched holes at an edge of the sheet.

5. The bookbinding system of claim 4, wherein the two punched-hole detection sensors are arranged such that adjacent punched holes are detected concurrently.

6. The bookbinding system of claim 1, wherein the detecting unit is arranged such that adjacent punched holes are detected concurrently.

7. The bookbinding system according to claim 1, wherein the presence of the holes is detected and a sheet size is determined based on detection results of only two punched-hole detection sensors of the detecting unit.

8. A bookbinding method that ring binds a sheet carried from an image forming apparatus by using a bookbinding device that includes a punching unit that performs a punching process of forming a punching hole on a sheet; an aligning unit that aligns a plurality of sheets having punching holes; a ring binding unit that mounts, in the punching holes of the sheets aligned by the aligning unit, a ring-shaped binding tool to create a booklet, the method comprising:

prohibiting, by a prohibiting unit if a sheet received from the image forming apparatus is a punched sheet having a punching hole thereon, the punching unit from performing the punching process on the punched sheet; and detecting, by a detecting unit of the prohibiting unit, whether or not the sheet received from the image forming apparatus in a punched sheet, and determining, by the detecting unit, the size of the sheet received from the imaging forming apparatus upon detecting that the sheet received from the image forming apparatus is a punched sheet, the detecting unit being arranged upstream of the punching unit in a sheet conveyance path, the detecting unit being arranged on a position wherefrom two adjacent punching holes, among multiple punching holes, can be detected on an end portion of the sheet, and the presence of the holes being detected and a sheet size being determined based on detection results of two punched-hole detection sensors of the detecting unit.

9. The bookbinding method of claim 8, wherein the detecting is performed based on detection results of only two punched-hole detection sensors of the detecting unit.

10. The bookbinding method of claim 9, wherein the two punched-hole detection sensors are arranged to concurrently detect adjacent punched holes at an edge of the sheet.

11. A computer program product including a non-transitory computer-readable recording medium and computer program code stored on the non-transitory computer-readable recording medium which when executed on a computer causes the computer to execute a bookbinding method that ring binds a sheet carried from an image forming apparatus by using a bookbinding device that includes a punching unit that performs a punching process of forming a punching hole on a sheet; an aligning unit that aligns a plurality of sheets having punching holes; a ring binding unit that mounts, in the punching holes of the sheets aligned by the aligning unit, a ring-shaped binding tool to create a booklet, the computer program code causing the computer to execute:

prohibiting, by a prohibiting unit, if a sheet received from the image forming apparatus is a punched sheet having a punching hole thereon, the punching unit from performing the punching process on the punched sheet; and detecting, by a detecting unit of the prohibiting unit, whether or not the sheet received from the image forming apparatus is a punched sheet, and determining, by the detecting unit, the size of the sheet received from the image forming apparatus upon detecting that the sheet received from the image forming apparatus is a punched sheet, the detecting unit being arranged upstream of the punching unit in a sheet conveyance path, the detecting unit being arranged on a position wherefrom two adjacent punching holes, among multiple punching holes, can be detected on an end portion of the sheet, and the presence of the holes being detected and a sheet size being determined based on detection results of two punched-hole detection sensors of the detecting unit.

12. The computer program product of claim 11, wherein the detecting is performed based on detection results of only two punched-hold detection sensors of the detecting unit.

13. The computer program product of claim 12, wherein the two punched-hole detection sensors are arranged to concurrently detect adjacent punched holes at an edge of the sheet.

* * * * *